US007673708B2

(12) United States Patent
Lee

(10) Patent No.: US 7,673,708 B2
(45) Date of Patent: Mar. 9, 2010

(54) BALL-ACTIVATED MECHANISM FOR CONTROLLING THE OPERATION OF A DOWNHOLE TOOL

(76) Inventor: Paul Bernard Lee, 15 Blue Ridge Place, Calgary, Alberta (CA) T3L 2NS ( * ) Notice: Subject to any disclaimer, the term of this patent is extended or adjusted under 35 U.S.C. 154(b) by 433 days.

(21) Appl. No.: 11/561,218

(22) Filed: Nov. 17, 2006

(65) Prior Publication Data

US 2007/0107944 A1 May 17, 2007

(30) Foreign Application Priority Data

Nov. 17, 2005 (GB) ..... 0523388.7

(51) Int. Cl.
*E21B 7/28* (2006.01)
*E21B 10/32* (2006.01)

(52) U.S. Cl. ..... 175/270; 175/268

(58) Field of Classification Search ..... 175/317, 175/237, 271, 268, 270
See application file for complete search history.

(56) References Cited

U.S. PATENT DOCUMENTS 5,499,687 A 3/1996 Lee
6,041,874 A * 3/2000 Lee ..... 175/101
6,820,697 B1 * 11/2004 Churchill ..... 166/374

FOREIGN PATENT DOCUMENTS

GB 2420803 A 7/2006
WO 2004088091 A1 10/2004

* cited by examiner

*Primary Examiner*—David J Bagnell
*Assistant Examiner*—Brad Harcourt
(74) *Attorney, Agent, or Firm*—Kirton & McConkie; Evan R. Witt

(57) ABSTRACT

A ball-activated mechanism adapted to be incorporated in a drillstring and to control the activation, and de-activation of a downhole tool. The mechanism includes a ball seat that receives surface launched activation balls and moves to activate or deactivate the downhole tool, an indexable latching device, and a linearly displaceable actuator co-operable with the indexable latching device, the actuator allowing pressure fluid communication to activate the tool when the actuator is in its activating position. Upon launch of a first activation ball, the ball seat moves so that the latching device carries out indexing movement to a latched position and moves the actuator moves to its activating position so that the downhole tool can be activated. Upon launch of a second activation ball, the latching device undergoes return movement and returns the ball seat to its first position and the actuator moves to deactivate the downhole tool.

3 Claims, 5 Drawing Sheets

BALL-ACTIVATED MECHANISM FOR CONTROLLING THE OPERATION OF A DOWNHOLE TOOL

This invention relates to a ball-activated mechanism for controlling the operation of a downhole tool of the type used in drilling boreholes, and particularly boreholes used in the extraction of liquid and/or gaseous hydrocarbon reserves.

In the formation of a borehole, it is usual to employ a so-called under-reamer, which is used to enlarge concentrically the diameter of a wellbore beyond a pilot drill bit size for improved casing running and cementing clearance. Current technology of under-reamers allow for only one activation of the reamer cutters i.e. once the cutters have been extended to radially outward active (open) positions (from inactive withdrawn positions housed within the reamer body), the cutters have remained in the open positions whenever drilling fluid is being pumped through the tool.

It is known from U.S. Pat. No. 5,499,687 to use deformable balls launched from the surface and down a drillstring to activate a downhole tool, but the present invention applies this known concept in a unique way for the control of a downhole tool, and especially an under-reamer, which enables the downhole tool to be activated by launch of one activation ball and to be de-activated by launch of a further activation ball.

SUMMARY OF THE INVENTION

According to the invention there is provided a ball-activated mechanism adapted to be incorporated in a drillstring and to control the activation, and de-activation of a downhole tool, said mechanism comprising:

a ball seat arranged to receive surface launched activation balls and movable from a first position to initiate activation of the downhole tool, and being returnable to the first position to initiate de-activation of the downhole tool;

an indexable latching device; and a linearly displaceable actuator co-operable with the indexable latching device and movable between activating and de-activating positions relative to the downhole tool, the actuator allowing pressure fluid communication to activate the tool when the actuator is in its activating position:

in which the arrangement of the mechanism is such that;

(A) upon launch of a first activation ball to engage the ball seat, the ball seat moves from its first position so that the latching device carries out indexing movement to a latched position whereby the actuator moves to its activating position so that the downhole tool can be activated; and (B) upon launch of a second activation ball to engage the ball seat, the latching device is operated to carry out return movement so that the ball seat returns to its first position and the actuator moves to its de-activating position.

The invention therefore enables a downhole tool to be triggered to operative and inoperative modes by the launch of actuation balls to engage the ball seat; to move the ball seat from its first position in order to initiate activation of the downhole tool; and to initiate return of the ball seat to its first position, under the action of the actuator and the indexable latching device, when a second activation ball is launched to engage the ball seat.

In a preferred embodiment, a downhole tool is incorporated in a bottom sub which is coupled with a top sub in which the mechanism of the invention is incorporated.

A particularly preferred downhole tool controlled by a ball-operated mechanism according to the invention is an under-reamer.

The indexable latching device may comprise an upper clutch, a lower clutch, and an intermediate clutch indexable between different latched conditions with respect to the upper and lower clutches.

The linearly displaceable actuator may comprise a mandrel coupled with the intermediate clutch for movement therewith, and which may be provided with a communication port which can be moved to and from fluid communication with actuator pistons in the downhole tool.

In the case of an under-reamer tool, the pistons maybe displaced inwardly and outwardly of the axis of the tool, and they are pressed outwardly by fluid pressure to urge the reamer cutters outwardly when fluid pressure is being pumped to the mechanism. The fluid pressure actuation of the pistons is preferably applied via pressure on one side of a leaf spring arrangement.

The ball seat is preferably arranged to receive a single activation ball, and which causes pressure upstream of the ball seat to increase and thereby trigger operation of the mechanism. However, as an alternative, the ball seat may be arranged to receive a cluster of smaller balls, triggering operation of the mechanism in generally similar manner to use of a single (larger) activation ball.

Similarly, a cluster of smaller balls may be received by the ball seat to trigger operation of the mechanism and thereby initiate de-activation of the downhole tool, in generally similar manner to use of the further (larger) activation ball.

After triggering of operation of the mechanism by the launch of the activation balls to engage the ball seat, the ball received by the ball seat is usually blown through to be received by a ball catcher.

The number of cycles of operation of the mechanism is therefore only limited by the capacity of the ball catcher. In a typical preferred arrangement, up to five cycles of operation (activation and deactivation of the downhole tool) can be obtained.

A preferred embodiment of ball-activated mechanism according to the invention will now be described in detail, for controlling the operation of a downhole tool to which it is coupled, by way of example only, with reference to the accompanying drawings.

DESCRIPTION OF PREFERRED EMBODIMENTS

Figures 1, 1A:
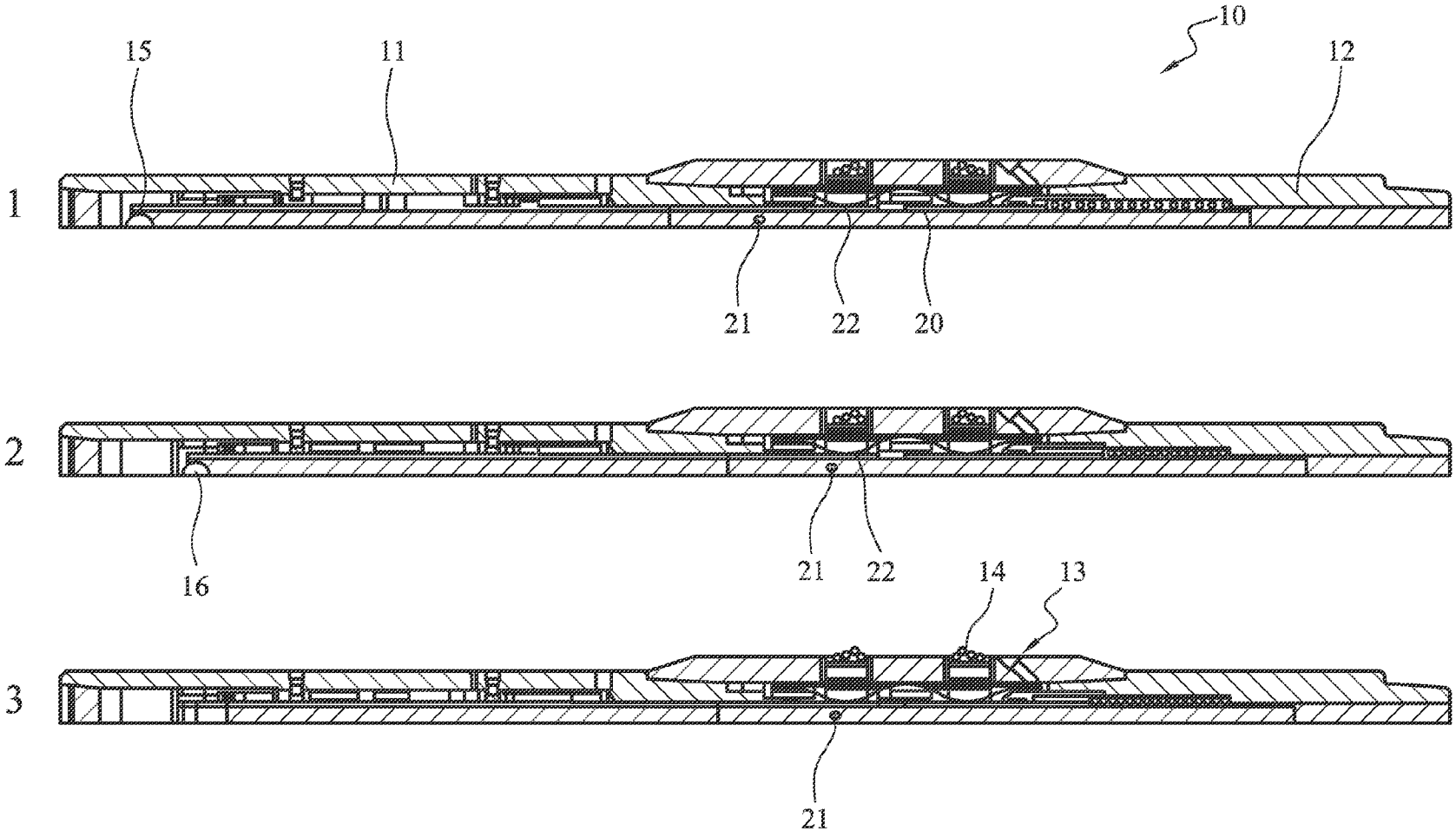
FIGS. 1*a* and 1*b* show three successive longitudinal sectional views (1, 2 and 3) of the internal components of the mechanism, showing, firstly, the mechanism in a de-activated mode; secondly after initiation of activation of the mechanism following launching of a large deformable activation ball from the surface down the drillstring, to engage a ball seat of the mechanism; and thirdly showing the related downhole tool, in the form of an under-reamer, activated to an operative condition following activation of the mechanism by the activation ball.
Figures 1, 1B:
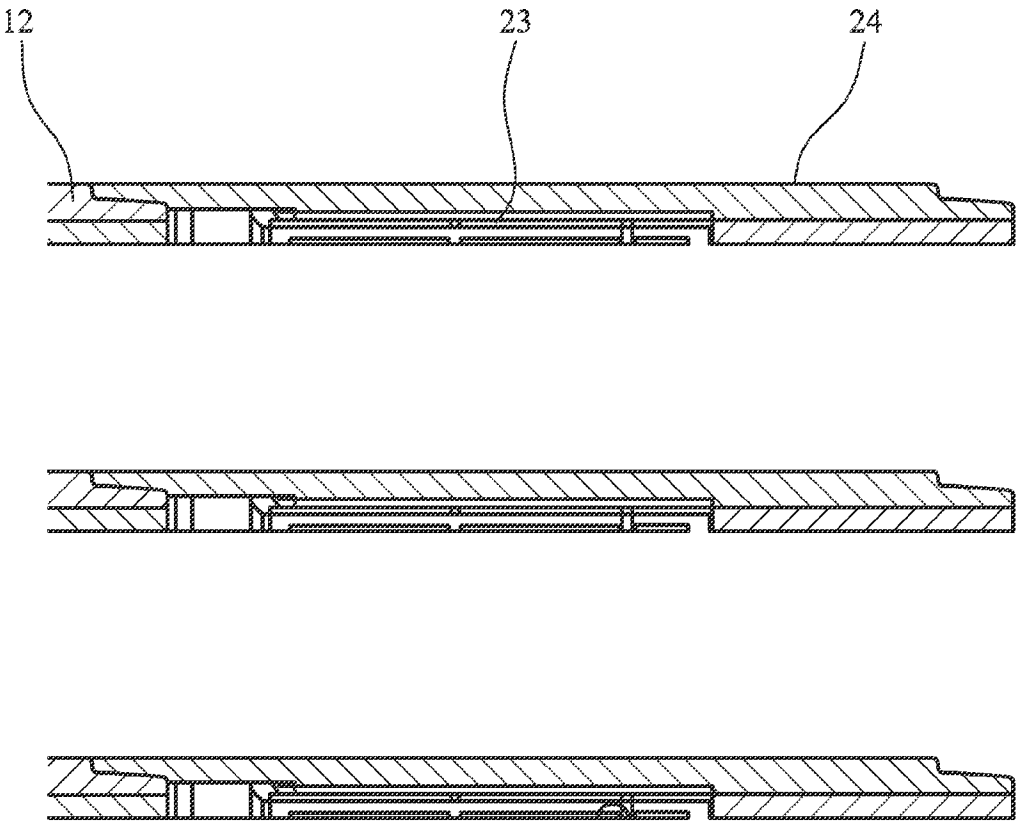

Referring now to the drawings, a ball-activated mechanism according to the invention is designated generally by reference 10 and which is adapted to be incorporated in a top sub 11 in a drillstring, and to control the activation, and deactivation of a downhole tool mounted in a bottom sub 12.

In the illustrated embodiment, the downhole tool takes the form of an under-reamer 13 having reamer cutter blades 14 which are radially movable under the action of actuator pistons between an outwardly projecting operative position shown in illustration 3 of FIG. 1*a*, and withdrawn positions within the body of the reamer as shown in illustrations 1 and 2 of FIG. 1*a*.

The mechanism 10 generally comprises: a ball seat 15 arranged to receive surface launched activation balls and movable from a first position shown in illustration 1 of FIG. 1*a* to a linearly displaced position shown in illustration 2, in order to initiate activation of the tool 13. The ball seat 15 is also returnable to its first position of illustration 1, to initiate deactivation of the tool 13.

Illustration 2 of FIG. 1*a* shows an activation ball 16 engaging with the ball seat 15, and after it has caused linear displacement of the mechanism to a position ready for activating the tool 13, as shown in illustration 2.

The mechanism also includes an indexable latching device taking the form of an upper clutch 17 and lower clutch 18, and a middle or intermediate clutch 19 which can be indexed between different latching positions with respect to the clutches 17 and 18.

The mechanism also includes still further a linearly displaceable actuator in the form of mandrel 20, which cooperates with the indexable latching device (17, 18, 19) and which is movable between activating and deactivating positions relative to the tool 13. The actuator mandrel 20 allows pressure fluid communication to activate the tool 13 when the actuator 20 is in its activating position, as shown in illustration 2 of FIG. 1*a*.

The arrangement of the mechanism 10 is such that, upon launch of a first activation ball 16 to engage the ball seat 15, the ball seat moves from its first position of illustration 1 to the position shown in illustration 2, and the indexable latching device (17, 18, 19) carries out indexing movement to a latched position whereby the actuator mandrel 20 moves to its activating position, whereby the downhole tool 13 can be activated.

The activated position of the tool 13 is shown in illustration 3 of FIG. 1*a*.

However, in order to deactivate the tool 13, it is only necessary to launch a second activation ball, similar to ball 16 of FIG. 1*a*, in the sense that it is also a large deformable ball. The launch of the second activation ball engages the ball seat 15 as shown in illustration 4 of FIG. 2*a*, and illustration 5 shows linear displacement of the components of the mechanism when fluid pressure upstream of the mechanism is applied to the activation ball 16. Illustrations 4 and 5 show the tool 13 in the outwardly deployed active mode, but after the mechanism reaches the position shown in illustration 5, the indexable latching device (17, 18, 19) is automatically released from its latched condition, and which then allows the mandrel 20 to return the components to the initial position shown in illustration 6, whereby fluid pressure action no longer is applied to the pistons operating the reamer cutter blades, and such are then withdrawn to the inoperative position shown in illustration 6.

The mandrel 20 is provided with at least one communication port 21 which can be moved into and out of fluid communication with cylinders housing the actuator pistons of the cutter blades 14. Illustrations 1, 2 and 3 of FIG. 1 show the different positions taken up by the communication port 21, which comprises a series of communication holes. Indirect fluid actuation is applied to the actuating pistons of the tool 13, via a leaf spring 22.

Figures 2, 2A:
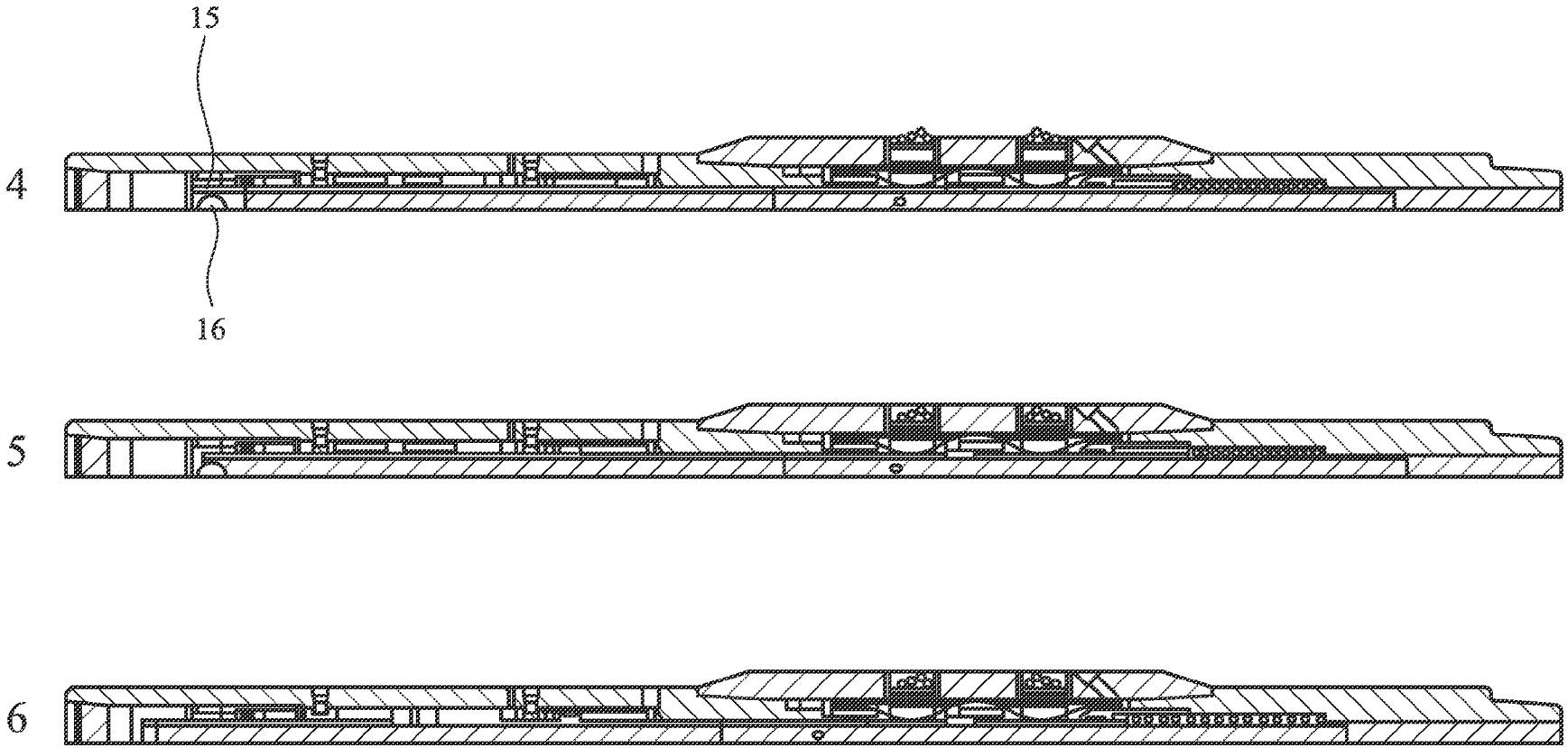
FIGS. 2*a* and 2*b* show, similarly to FIGS. 1*a* and 1*b*, three successive positions (4, 5, 6) taken up by the components of the mechanism prior to and during the launch of a further activation ball to initiate deactivation of the downhole tool.
Figures 2, 2B:
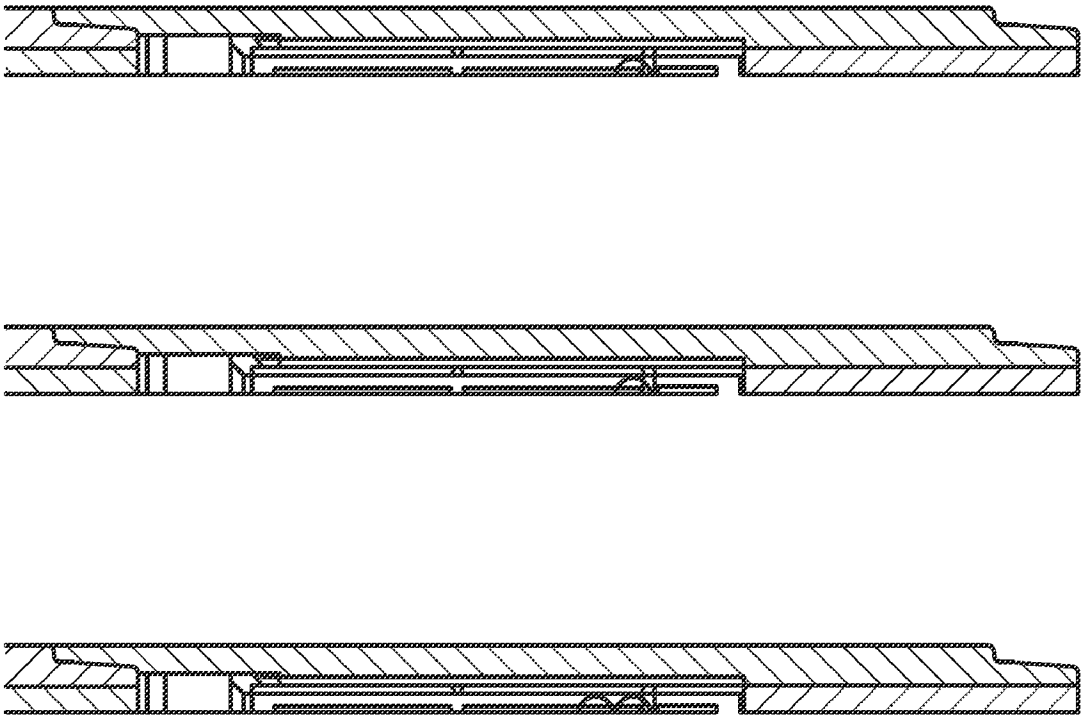
Figure 3B:
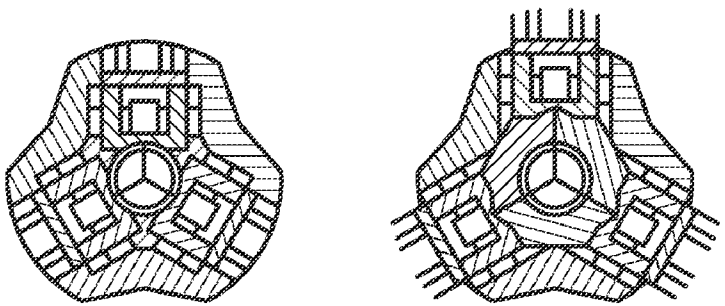
FIG. 3*b* shows transverse sectional illustrations of the under-reamer, showing how the reamer cutters can be displaced radially outwardly from withdrawn inoperative positions housed within the reamer body, to outwardly projecting operational positions.
Figure 3A:
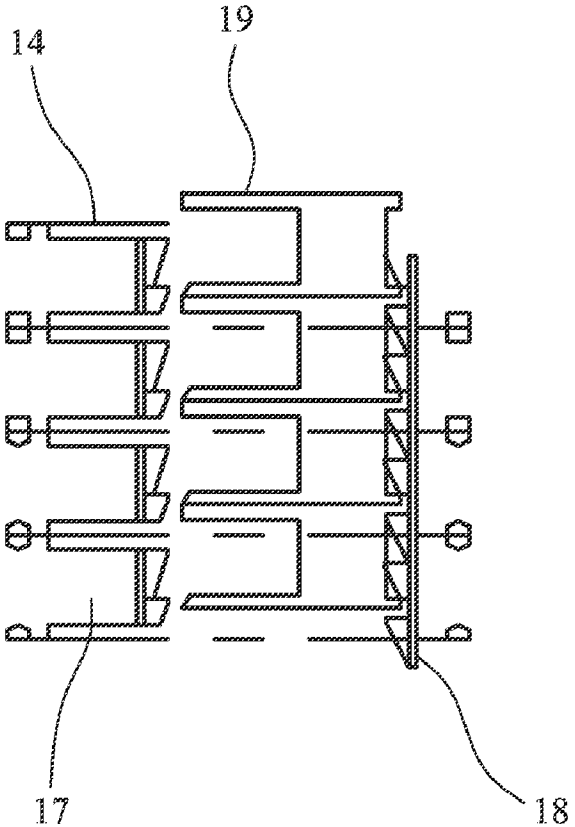
FIG. 3*a* is a detail view illustrating clutch components of an indexable latching device incorporated in the mechanism.

Illustrations 4, 5 and 6 of FIG. 2*a* also show the different positions taken up by the movable components of the mechanism 10, following initiation of deactivation by launching of a second ball 16 to engage ball seat 15.

After each launched ball 16 has engaged the ball seat 15 and moved to the linearly displaced positions of illustration 2 of FIG. 1*a* and illustration 5 of FIG. 2*a*, the ball is then blown through the interior of the tool by fluid pressure action, and is then caught by a ball catcher device 23 housed in a ball catcher sub 24. The mechanism 10 remains in the positions shown in illustrations 2 and 5, by virtue of the latching of the indexable latching device (17, 18, 19), despite the activation ball having been blown though the ball seat. The ball catcher device 23 can house up to 10 activation balls, thereby enabling the tool to be cycled through five cycles of operation.

The ball-activated mechanism 10 disclosed herein is effectively a "ball drop clutch mechanism", which is also a selective multiple activation system. This system is either closed, or open, and is changed to the alternate position by dropping a ball. In the closed position, the cutter bodies of the under-reamer are contained in the main body, and all flow is applied to the BHA below the under-reamer, with no chance of cutter opening. However, when activation is required, a ball is dropped into the tool string, and the cutters are opened and will remain open at any time the pumps are operating.

When deactivation is required, another ball (the same size) is dropped. The cutters will retract, and remain contained within the main body, and fluid flow goes to the BHA. This cycle can be repeated up to the capacity of the ball catcher sub (five openings, five closings on standard length sub). This tool can be utilised for a wide variety of applications; opening to enlarge only zone of interest; continuation of drilling with pilot bit after hole opening zone has been completed; and closing tool for cleaning out casing after run is completed.

The mechanism therefore has a selective ability, and which provides the drilling operator with additional drilling and circulation options, to optimize hole cleaning, well control and other drilling parameters not available with current tools.

The under-reamer is run in the hole as part of the BHA in the closed position. The under-reamer uses a combination of a clutch system and hydraulic fluid pressure to extend cutting systems. The clutch system controls movement of the mandrel having communication ports. Upon completing any required drilling, circulating or hole cleaning, a ball is dropped into the drill string. This ball lands on the seat in the top of the tool, and cycles the tool into the open position. The ball is then sheared via pressure through the ball seat and is captured in the ball catcher sub located at the bottom of the tool.

At this time, whenever the pumps are turned on, the cutter blocks are hydraulically opened and activated, allowing under-reaming operations. Whenever closing is required, another ball of the same size is dropped into the drillstring, and when it lands on the seat, it cycles the tool into the closed position. This second ball is then sheared and captured in the ball catcher sub. Now, whenever the pumps are turned on, the cutters remain inside the tool body, with full drilling fluid flow being directed to the bottom hole assembly below the reamer.

I claim:

1. A ball-activated mechanism adapted to be incorporated in a drillstring and to control the activation, and de-activation of an under reamer, said mechanism comprising:

a ball seat arranged to receive surface launched activation balls and movable from a first position to initiate activation of the under reamer, and being returnable to the first position to initiate de-activation of the under reamer;

an indexable latching device comprising an upper clutch, a lower clutch, and an intermediate clutch indexable between different latched conditions with respect to the upper and lower clutches; and a linearly displaceable actuator comprising a mandrel coupled with the intermediate clutch for movement therewith, the linearly displaceable actuator co-operable with the indexable latching device and movable between activating and de-activating positions relative to the under reamer, the actuator allowing pressure fluid communication to activate the under reamer when the actuator is in its activating position, wherein the mandrel is provided with a communication port which can be moved to and from fluid communication with actuator pistons in the under reamer and in which the actuator pistons are displaceable in directions towards and away from the axis of the under reamer, and are pressed away from the axis by fluid pressure to urge the reamer cutters away from the axis when fluid pressure is pumped to the mechanism:

in which the arrangement of the mechanism is such that;

(A) upon launch of a first activation ball to engage the ball seat, the ball seat moves from its first position so that the latching device carries out indexing movement to a latched position whereby the actuator moves to its activating position so that the under reamer can be activated; and (B) upon launch of a second activation ball to engage the ball seat, the latching device is operative to carry out return movement so that the ball seat returns to its first position and the actuator moves to its de-activating position thereby to deactivate the under reamer.

2. A mechanism according to claim 1, and incorporated in a top sub, in which the under reamer is incorporated in a bottom sub which is coupled with the top sub.

3. A mechanism according to claim 1, in which fluid pressure actuation of the pistons is provided by applying fluid pressure to one side of a leaf spring arrangement.

* * * * *